US005946932A

United States Patent [19]

Wang

[11] Patent Number: 5,946,932

[45] Date of Patent: Sep. 7, 1999

[54] MULTISTAGE CONDENSING STRUCTURE

[76] Inventor: Huai-Wei Wang, No. 10, Lane 145, Chung-Mei Rd., Sec. 2, Chungli City, Taoyuan Hsien, Taiwan

[21] Appl. No.: 09/095,836

[22] Filed: Jun. 11, 1998

Related U.S. Application Data

[63] Continuation-in-part of application No. 09/090,273, Jun. 3, 1998.

[51] Int. Cl.[6] ..... F25B 6/04

[52] U.S. Cl. ..... 62/305; 62/316; 62/506; 165/117; 261/154

[58] Field of Search ..... 62/259.4, 506, 62/507, 305, 316; 165/117; 261/154

[56] References Cited

U.S. PATENT DOCUMENTS

| | | | |
|---|---|---|---|
| 2,181,354 | 11/1939 | Winters | 62/305 X |
| 3,658,581 | 4/1972 | Paul et al. | 427/379 |
| 3,984,995 | 10/1976 | Starr et al. | 62/305 |
| 4,440,216 | 4/1984 | Conti | 165/117 |
| 4,672,817 | 6/1987 | Croce | 62/506 X |
| 4,974,422 | 12/1990 | Kocher | 62/305 |

*Primary Examiner*—Henry Bennett
*Assistant Examiner*—Marc Norman
*Attorney, Agent, or Firm*—Dougherty & Troxell

[57] ABSTRACT

A multistage condensing structure using a liquid dispensing means to transfer droplets of evaporative cooling liquid onto an air-cooled condenser, taking advantage of the conventional air-cooled condensing method and the evaporation method using a liquid coolant. To further increase the efficiency of the air conditioner, two or more condensing units can be arranged in tandem along the blowing direction of a common air blower. With two or more condensing units arranged in tandem, the contacting area between the evaporation surfaces and the air flow can be enlarged to increase the evaporation efficiency without significantly increasing the size of the air conditioner. The multistage condensing structure, with its continuous heat-exchange along the flow of the refrigerant in the coiled pipe, causes an increase in the subcooling condition in the refrigerant. This condensing structure can, therefore, achieve a much higher E.E.R. than the known method of air cooling.

4 Claims, 5 Drawing Sheets

MULTISTAGE CONDENSING STRUCTURE

This is a continuation-in-part of copending application Ser. No. 09/090,273, filed on Jun. 3, 1998.

FIELD OF THE INVENTION

The present invention is related to a structure of the condensing unit in an air conditioner.

BACKGROUND OF THE INVENTION

Among the many different types of condenser that can be used in an air conditioner, the most widely used condenser is the heat-exchanger that uses fins and forced air to reduce the temperature of the refrigerant. The energy efficiency ratio (E.E.R.) of this type of condenser, however, is quite low. It is advantageous to provide a structure for the condensing unit and a method of heat-exchange in an air conditioner with higher efficiency.

SUMMARY OF THE INVENTION

It is an objective of the present invention to provide a structure of heat exchanger which can efficiently use evaporation as a means for reducing the temperature of the refrigerant.

It is another objective of the present invention to provide a condenser which has a greater evaporation surface while maintaining a small physical dimension.

In order to achieve the above-identified objectives, the multistage condensing structure, according to the present invention, uses a liquid dispensing means to transfer droplets of evaporative cooling liquid onto an air-cooled condenser, taking advantage of the conventional air-cooled condensing method and the evaporation method using a liquid coolant. To further increase the efficiency of the air conditioner, two or more condensing units can be arranged in tandem along the blowing direction of an air blower. With two or more condensing units arranged in tandem, the contacting area between the evaporation surfaces and the air flow can be enlarged to increase the evaporation efficiency without significantly increasing the size of the air conditioner. The multistage condensing structure, with its continuous heat-exchange along the flow of the refrigerant in the coiled pipe, enhances the subcooling condition in the refrigerant. This condensing structure can, therefore, achieve a much higher E.E.R. than the known method of air cooling. It should be noted that even when the multistage structure, according to the present invention, operates without the use of evaporative cooling liquid, its efficiency is still higher than the conventional air-cooling method.

The evaporative cooling liquid that is used for spraying can be water or any known liquid coolant and a combination of different coolants.

The multistage condensing structure, according the present invention, can be readily understood upon reading the description of the drawings.

DETAILED DESCRIPTION OF THE PREFERRED EMBODIMENTS

Figure 1:
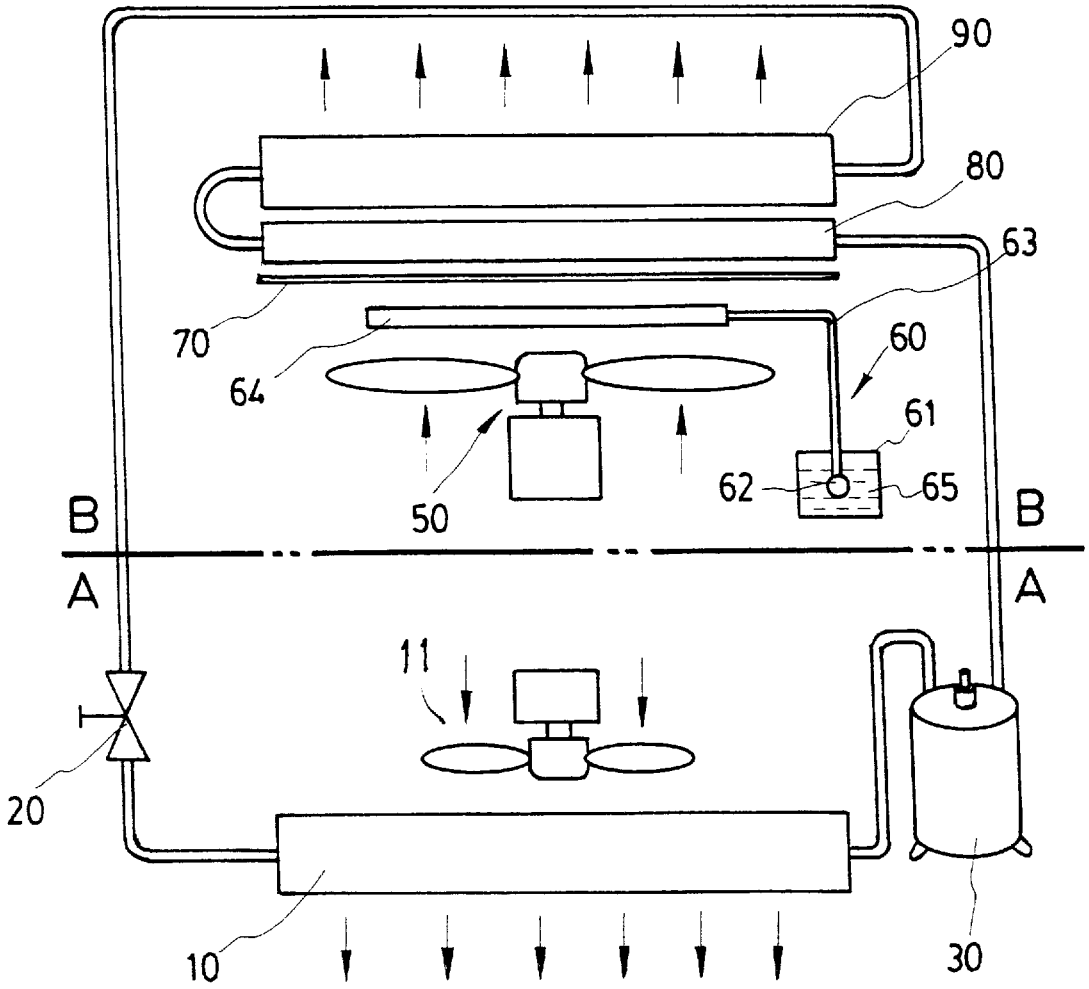
FIG. 1 is a schematic view of the operation of the air conditioner using the multistage condensing structure, according to the present invention.

A schematic view for the operation of the air conditioner of the present invention is shown in FIG. 1. As shown in FIG. 1, the air conditioner is divided into an indoor section A and an outdoor section B. As shown in the indoor section A, after the refrigerant is expanded into an evaporator 10 by the expansion device 20, it's pressure and temperature are lowered. A fan 11 is used to force an air flow through the evaporator 10 to provide cool air for the indoor. After passing through the evaporator 10, the refrigerant is recompressed into a high pressure gas by means of a compressor 30. The compressed gas is lead into the outdoor section B through a plurality of condensing units, 80 and 90, and the refrigerant is lead back to the expansion device 20.

Figure 2:
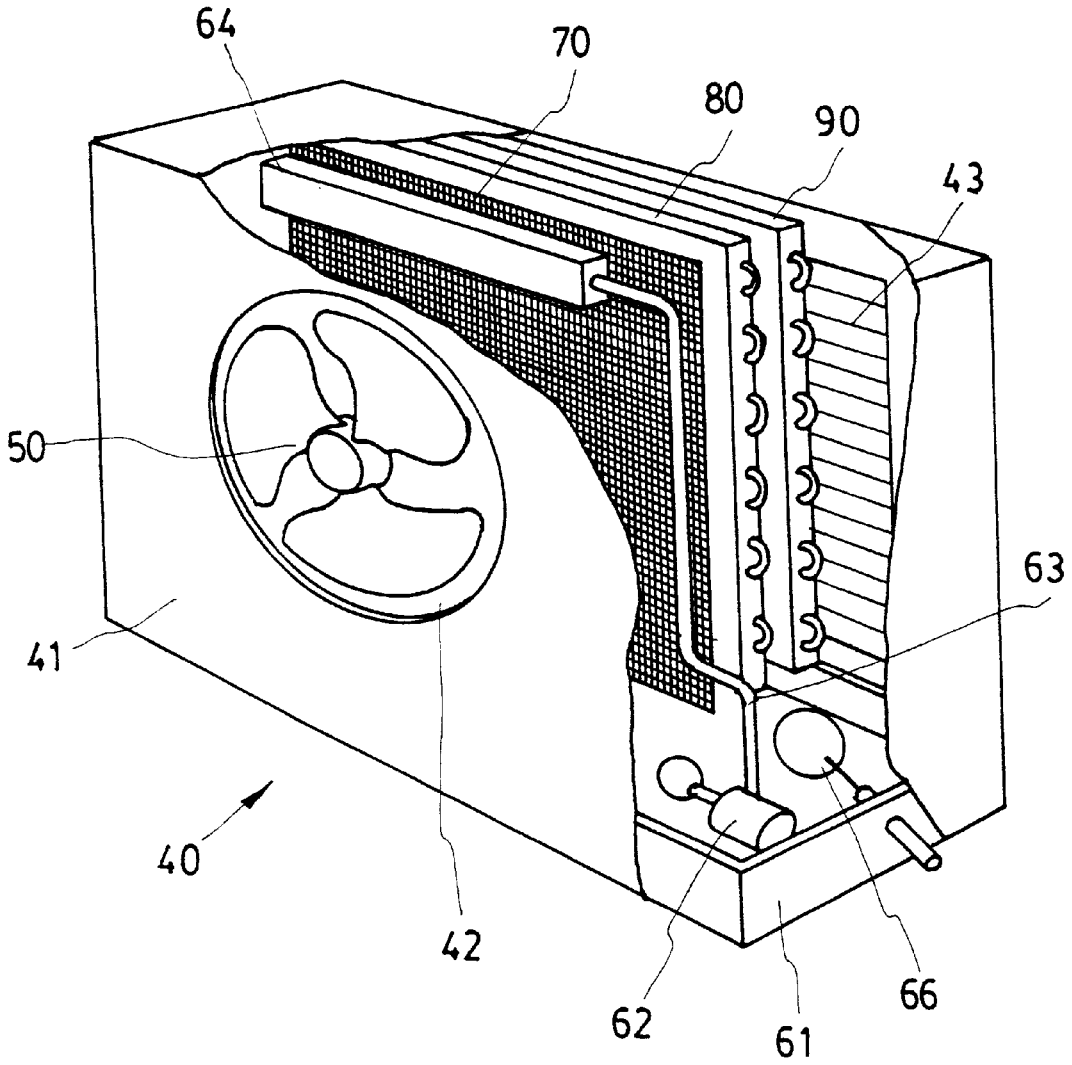
FIG. 2 is a perspective view of the multistage condensing structure, showing a partial cutout section.

As shown in FIG. 1 and FIG. 2, the outdoor section B which is denoted by numeral 40 includes a first condensing unit 80 and a second condensing unit 90, enclosed by a casing 41 having an air intake opening 42. An evaporative cooling liquid supplying unit 60 having a liquid container 61 is used to store a certain amount of evaporative cooling liquid 65. The evaporative cooling liquid, which can also be water, is fed through a pipe 63 by feeding means 62 to a liquid dispenser 64. An air blower 50 is provided to transfer the liquid dispensed from the liquid dispenser 64 onto a liquid droplet distributor 70 which produces a mist or a spray of droplets along the wind direction. These evaporative liquid droplets are sprayed on the first and the second condensing units. Preferably, a liquid-lever sensing switch 66 is provided in the proximity of the liquid container 61 to ensure a proper amount of evaporative cooling liquid is in the container. The liquid dispensed from the liquid dispensing means 64 is directly sprayed face-on to the condensing units 80 and 90 by the action of forced air from the blower 50, but it can also be allowed to drip onto the condensing units from above.

Figure 3:
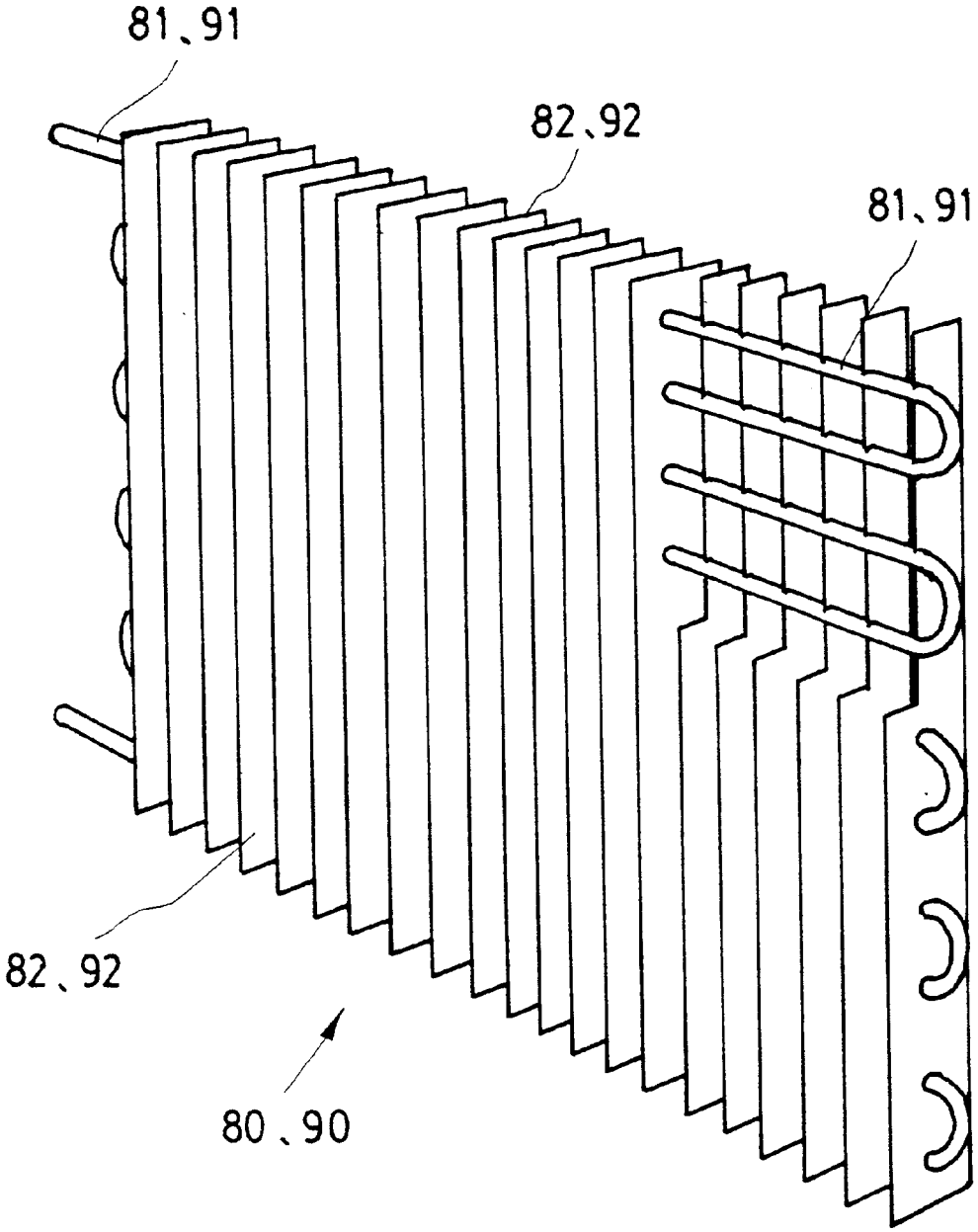
FIG. 3 is a perspective view of a condenser with fins, showing a partial cutout section.

The schematic view of the condensing unit 80 or 90 is shown in FIG. 3. As shown, the condensing unit 80 or 90 consists, respectively, of a plurality of coiled pipe sections 81, or 91, arranged in an up-and-down array, one section over another. A plurality of fins 82, or 92, are installed on the coiled pipe to conduct heat away therefrom. Sufficient spacing is provided between two adjacent fins and between two coiled pipe sections to allow air and water droplets to pass through easily. In order to increase the evaporation surfaces and to have a better water-retaining condition, the surface of the fins and the external wall of the coiled pipe can have a rough surface finish. The end of the coiled pipe 81 of the first condensing unit 80 is guided to the second condensing unit 90 to become the coiled pipe 91.

The second condensing unit 90 is arranged behind the first condensing unit 80 along the blowing direction of the blower 50 in such a fashion that one common blower can effectively cause evaporation in more than one condensing unit. In fact, when necessary, it is plausible to have more than two condensing units arranged in tandem to share the airflow from one common blower.

Figure 4:
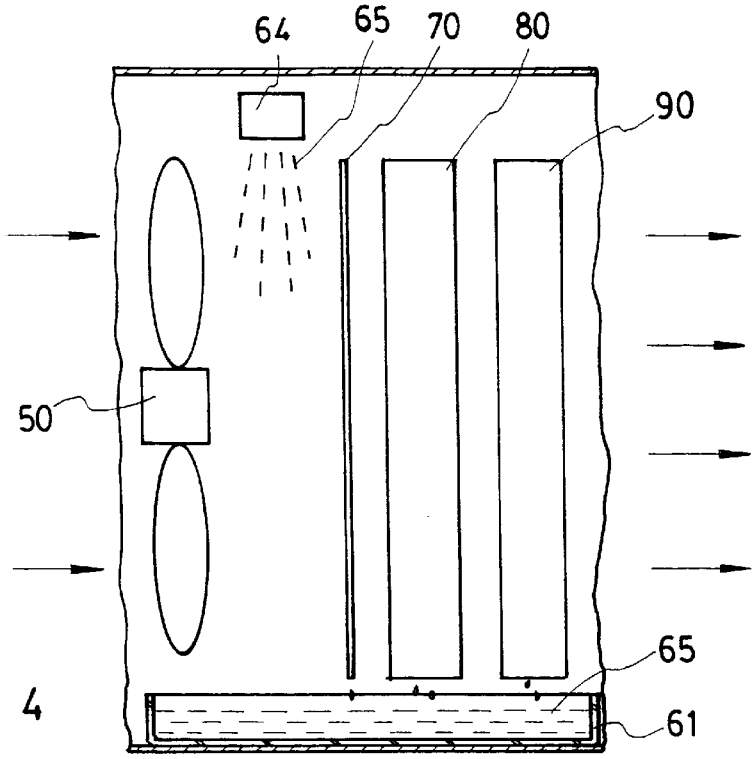
FIG. 4 is a schematic diagram of the multistage condensing structure with two condensing units arranged in tandem.

The schematic view of the multistage condensing structure, according to the present invention, is shown in FIG. 4. As shown, the evaporative cooling liquid 65 is dispensed through the liquid dispenser 64 and the dispensed liquid is transferred to the liquid droplet distributor 70 by the air flow from the blower 50. The liquid droplet distributor 70 produces a mist or spray of droplets of evaporative cooling liquid, to be sprayed onto the evaporative surface of the fins and external wall of the coiled pipe in the first condensing unit 80 and the second condensing unit 90. As shown, the liquid container 61 is also provided to catch the evaporative cooling liquid 65 dripped down from the condensing units 80 and 90 and other surrounding area. It should be noted that even when only one condensing unit 80 is used to receive the liquid droplets, the heat-exchange efficiency of the air-conditioner is higher than the conventional air-cooling method.

Figure 5:
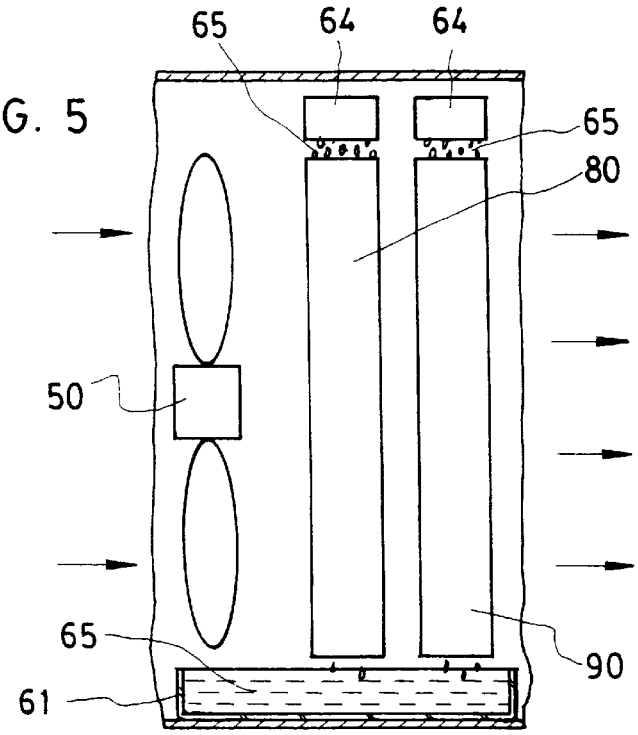
FIG. 5 is a schematic diagram of the multistage condensing structure with two condensing units, using a different liquid dispensing arrangement.

FIG. 5 shows a schematic of the multistage condensing structure having a different liquid dispensing arrangement. As shown, a plurality of liquid dispensers 64 are installed above the first and second condensing units. Droplets of the evaporative cooling liquid 65 are allowed to drip, by the action of gravity, on the evaporation surfaces of the condensing units 80 and 90. It should be noted that the droplets can also be forced out of the liquid dispenser by a pump or a similar device.

Figure 6:
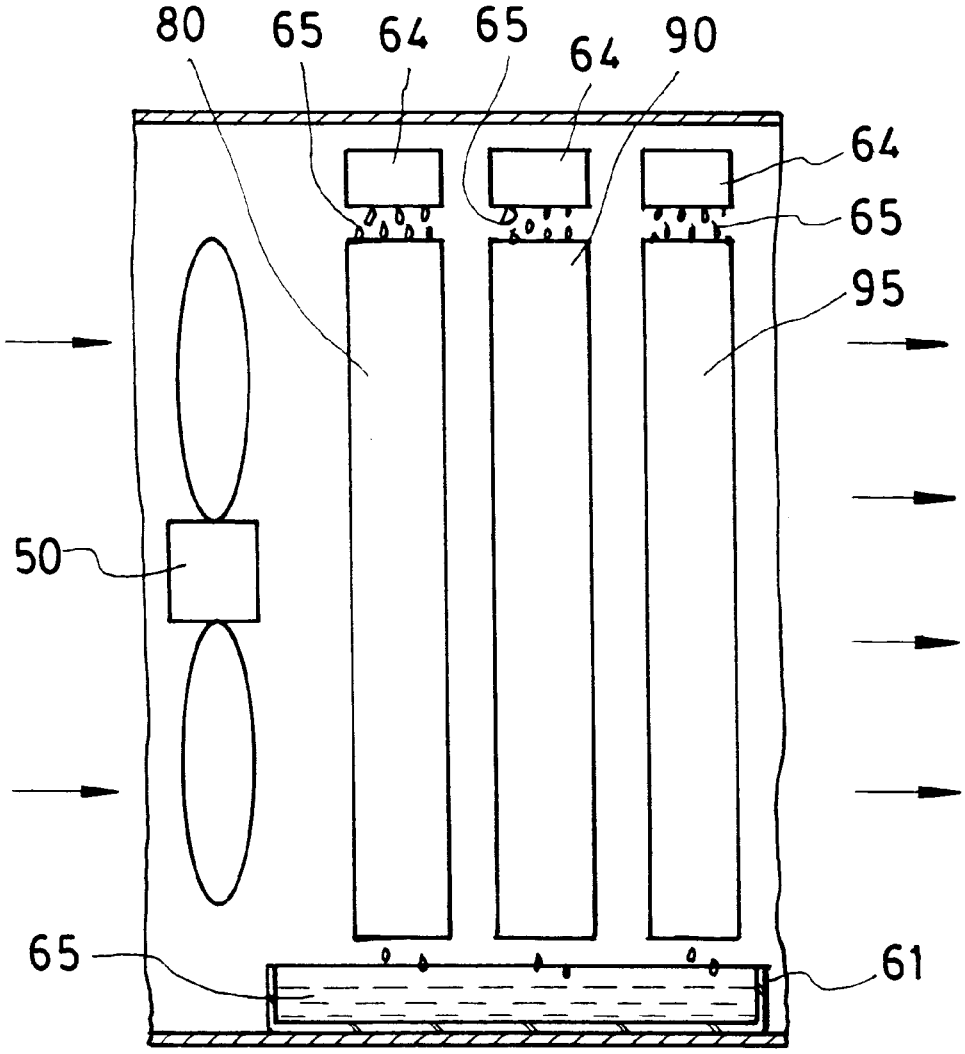
FIG. 6 is a schematic diagram of the multistage structure with three condensing units arranged in tandem.

FIG. 6 shows a schematic of the multistage condensing structure having three condensing units. As shown, a third condensing unit 95 is arranged behind the second condensing unit 90. The third condensing unit and the second condensing unit can be similar to or different from each other. Above each condensing unit, a liquid dispenser 64 is used to supply a sufficient amount of droplets of evaporative cooling liquid 65 for reducing the temperature of the refrigerant in the coiled pipe in each condensing unit. It should be noted that, with each condensing unit having its own liquid dispenser, more than three condensing units can be arranged in tandem to increase the efficiency of heat exchange, even when the airflow from the blower 50 is considerably weakened when it reaches the condensing units in the far end. The multistage condensing structure has the advantage of having increased evaporation surfaces without significantly increasing the size of the air conditioner. Furthermore, even when the evaporative cooling liquid is depleted or not in use, the multistage condensing structure, according to the present inventions is more efficient than the conventional air-cooled air conditioner. Moreover, in the multistage condensing structure having a plurality of liquid dispensers 64, as shown in FIG. 5 and FIG. 6, one or more third condensing units 95 that are different from the first condensing unit 80 shown in FIG. 3 can be used along with one or more first condensing unit 80. For example, the third condensing unit 95 can have one or more layers of water-retaining material wrapped around the coiled pipe, instead of having fins. This water-retaining material can help keeping the evaporative cooling liquid in constant contact with the external wall of the coiled pipe.

The present invention has been disclosed in preferred forms and the drawing figures are for illustrative purposes only. It shall be understood by those skilled in the art that many modifications, additions and deletions can be made therein without departing from the scope of the invention as set forth in the appended claims.

What is claimed is:

1. A multistage condensing structure to be used in an air conditioner having a compressor, an expansion device, an evaporator and a fan associated with the evaporator to blow cooled air from the air conditioner, a network of pipelines to provide conduit for refrigerant in the air conditioner, an air blower and means for dispensing evaporative cooling liquid the multistage condensing structure comprising a plurality of condensing units each having an array of coiled pipe sections to receive evaporative cooling liquid dispensed from said dispensing means, said condensing units being arranged in tandem along a blowing direction of said air blower to allow air flow from said air blower to aid the evaporation of the cooling liquid dispensed on the condensing units, wherein said liquid dispensing means is installed behind said air blower so as to allow the evaporative cooling liquid dispensed by said liquid dispenser to be transferred to the condensing units by said air blower.

2. The multistage condensing structure of claim 1 wherein said liquid dispensing means is installed above the condensing units to provide droplets of the evaporative cooling liquid thereon.

3. The multistage condensing structure of claim 1 wherein each of said condensing units comprises a plurality of fins installed on the coiled pipe sections to provide additional evaporation surfaces.

4. The multistage condensing structure of claim 1 wherein said coiled pipe has a rough surface finish.

* * * * *